US009546833B2

(12) United States Patent
Yollu

(10) Patent No.: US 9,546,833 B2
(45) Date of Patent: Jan. 17, 2017

(54) OPERATING SYSTEM IN THE SEMI-AUTOMATIC FIREARMS

(71) Applicant: ATA SILAH SAN. A.S., Istanbul (TR)

(72) Inventor: Fatih Yollu, Istanbul (TR)

(73) Assignee: ATA SILAH SAN. A.S., Istanbul (TR)

( * ) Notice: Subject to any disclaimer, the term of this patent is extended or adjusted under 35 U.S.C. 154(b) by 0 days.

(21) Appl. No.: 14/419,846

(22) PCT Filed: May 27, 2013

(86) PCT No.: PCT/TR2013/000157

§ 371 (c)(1),
(2) Date: Feb. 5, 2015

(87) PCT Pub. No.: WO2014/025326

PCT Pub. Date: Feb. 13, 2014

(65) Prior Publication Data

US 2015/0226503 A1 Aug. 13, 2015

(30) Foreign Application Priority Data

Aug. 6, 2012 (TR) ..... 2012/9140

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/20; F41A 5/26; F41A 5/28; F41A 5/30; F41A 5/02; F41A 19/55; F41A 3/90; F41A 3/92; F41A 21/26;F41A 21/28; F41A 21/36; F41A 3/62; F41C 7/02; F41C 7/025
See application file for complete search history.

(56) References Cited

U.S. PATENT DOCUMENTS 2,865,256 A * 12/1958 Marsh ..... F41A 3/62 89/191.01
2,909,101 A * 10/1959 Hillberg ..... F41A 3/32 89/191.02
2,987,967 A * 6/1961 Wild ..... F41A 5/28 227/9
3,020,807 A * 2/1962 Hailston ..... F41A 5/28 89/193
3,127,812 A * 4/1964 Into ..... F41A 5/28 89/193
3,568,564 A * 3/1971 Badali ..... F41A 5/18 89/191.02
3,601,002 A * 8/1971 Janson ..... F41A 5/26 89/191.02

(Continued)

*Primary Examiner* — Derrick Morgan
(74) *Attorney, Agent, or Firm* — Duane Morris LLP; J. Rodman Steele, Jr.; Gregory M. Lefkowitz

(57) ABSTRACT

The invention relates to a semi-automatic firearm comprising a hand stock nut (1), bracket (6), piston (7), magazine tube plug (8), magazine tube (9), gas tube (10), mechanism (11), lock bolt (12), body (13), lock (14); bolt arm (15), hand stock (16), barrel cap (17) and barrel (18). In order to enable the use of cartridges with different loads and to reduce the recoil, said firearm comprises a valve piston (5) connected with the piston (7) between the gas tube (10) and magazine tube (9) and the hand stock nut (1). Depending on the pressure generated by the cartridge the valve piston (5) is able to release excess gas through discharge holes (20).

8 Claims, 4 Drawing Sheets

Detail - A

(56) References Cited

U.S. PATENT DOCUMENTS 3,848,511 A * 11/1974 Zanoni ..... F41A 5/26 89/191.02
3,869,961 A * 3/1975 Kawamura ..... F41A 5/18 89/191.02
3,968,727 A * 7/1976 Hyytinen ..... F41A 5/28 89/191.02
4,492,050 A * 1/1985 Kagehiro ..... F41A 21/28 42/1.06
4,702,146 A * 10/1987 Ikeda ..... F41A 5/28 89/193
4,872,392 A * 10/1989 Powers ..... F41A 5/26 137/512.15
4,901,623 A * 2/1990 Lee ..... F41A 5/26 89/191.02
5,429,034 A * 7/1995 Badali ..... F41A 5/28 89/191.02
5,872,323 A * 2/1999 Norton ..... F41A 5/26 89/191.02
6,279,258 B1 * 8/2001 Hashman ..... F41A 5/18 42/16
6,382,073 B1 * 5/2002 Beretta ..... F41A 5/26 89/191.01
6,508,160 B2 * 1/2003 Beretta ..... F41A 5/26 89/191.01
7,946,214 B2 * 5/2011 Stone ..... F41A 5/18 89/193
8,250,964 B2 * 8/2012 Stone ..... F41A 5/26 89/193
8,312,656 B2 * 11/2012 Lesenfants ..... F41A 9/14 42/16
8,640,598 B1 * 2/2014 Jackson ..... F41A 5/20 89/191.01
2003/0084780 A1 * 5/2003 Rosenthal ..... F41A 21/28 89/14.3
2008/0173168 A1 * 7/2008 Gussalli Beretta ..... F41A 3/26 89/173
2010/0071243 A1 * 3/2010 Lesenfants ..... F41A 3/36 42/69.01

* cited by examiner

Detail - A

OPERATING SYSTEM IN THE SEMI-AUTOMATIC FIREARMS

CROSS-REFERENCE TO RELATED APPLICATIONS

This application is a §371 national stage entry of International Application No. PCT/TR2013/000157, filed May 27, 2013, which claims priority to Turkish Patent Application No. 2012/9140, filed Aug. 6, 2012, the entire contents of which are incorporated herein by reference.

DESCRIPTION OF THE TECHNICAL FIELD

The invention relates to the semi-automatic firearms. The invention relates in particular to a novel operating system for the semi-automatic firearms wherein the kickback force is absorbed without the need to use two separate pistons for the lightweight and heavyweight cartridges.

DESCRIPTION OF THE STATE OF ART

The hunting rifles have a wide range of cartridge weights from 24 g up to magnum cartridges. These cartridges have different pressure values. As a result, two separate types of pistons are used in the existing hunting rifles that operate on the gas recoil. The reason for this is that a heavy charged piston reduces the recoil force due to the gas pressure in the high pressure cartridges. Another reason is that a lightweight charged piston generates the force that would enable the operation of the mechanisms of the rifle in the low pressure cartridges.

According to the current practice, there is the necessity to use two types of pistons. This has the disadvantage that the handling and storage for one piston cause difficulty while the other piston is, in mounted state. The other piston may become lost or subject to damage due to the storage conditions. Another problem is the difficulties encountered during the mounting of the piston on the firearm. There is a need to resolve the problems related to such undesirable conditions.

In the current practice, there is a big kickback force during the use of the heavy cartridges and the high recoil force results in a significant blow on the shoulder of the user, which causes difficulties in use.

The invention according to the utility model application no. TR 2003/01084 entitled "motion regulator for gas rifles" relates to a motion regulator for the gas rifles. It is a regulator system for the auto loader rifles operating on the gas system, said regulator system protecting the components of the rifle by reducing the excessive blow effect formed in the mechanism and the operating arrangement due to the sudden recoil of the operating gas and enabling the stable operation of the rifle by regulating the speed of the mechanism, said regulator system featuring the ability of shock absorption and of retardation of the start of the mechanism action, said regulator system being comprised by a spring regulation portion that transfers in a controlled manner the motion obtained by the operating gas pushing back the piston to the mechanism and an arm connecting portion that bears the operating arm.

The invention according to the utility model application no. TR 2006/01838 entitled "gas piston system for the rifles" relates to "gas piston for the rifles". It is a gas piston system, which enables, by means of a piston, the powder gas pressure formed during the shot in the firearms such as rifle to be applied as a an unlocking force to the mechanism, said gas piston system being positioned in the direction of the mechanism-barrel axis.

The invention according to the utility model application no. TR 2010/00430 entitled "gas piston mechanism able to be used with cartridges with different amounts of load" is a gas piston mechanism able to be used with cartridges with different amounts of load, said mechanism being used in semi-automatic and/or automatic firearms, especially rifles; said mechanism enabling a portion of the gas pressure released from the barrel during the firing of the cartridges that contain different amounts of powder to be transmitted to the gas chamber to compress the mechanism spring to cock the mechanism for the next firing, while discharging the excess of the gas from the rifle; said mechanism being positioned on the inner piston; said mechanism transmitting, according to the required amounts and in an adjustable manner, the forces generated in the direction of compression with the piston nut positioned on the outer piston and the outer pass in order to enable the cocking of the mechanism; said mechanism comprising at least one leaf spring and being able to be used with cartridges having different amounts of load.

The invention according to the patent application no. TR 2010/07241 entitled "gas piston system" relates to a gas piston system for the firearms, said system being made of screw, securing screw, gas piston rod and gas piston carrier steel alloys. Said system is designed to enable the powder gas formed during the firing in all the light firearms such as the semi-automatic assault rifle, fully automatic assault rifle, hunting rifle and the like to pass from the barrel via the gas hole into the gas chamber in order to move backwards the gas piston rod under the influence of the pressure, thereby enabling the same to hit the mechanism carrier to allow it to be released from the locked position, said system being designed to achieve these actions using a minimum number of subcomponents. Owing to the action of the push back rod without spring being performed by the mechanism, the invention also eliminates the problem of "carrier bounce" causing the interruption of the automatic shot.

The invention according to the utility model application no. TR 2010/10969 entitled "gas piston mechanism developed for firearms" relates to "gas piston mechanism" that eliminates the pollution and jam caused by the gas, provides the motion cycle during the operation of the firearm and is realized in the mechanisms of the firearms that operate based on the principle of gas recoil.

There is needed a novel operating system by means of which two of the significant problems encountered in the state of the art may be solved, i.e. the absorption of the kickback force of the heavy cartridges may be enabled and the need to replace the pistons according to the structure of cartridge may be eliminated.

In the light of the problems and applications described hereinabove, it has become necessary to develop a novel solution.

DESCRIPTION OF THE OBJECTS OF THE INVENTION

Based on the mentioned state of the art, the object of the invention is to develop a novel operating system in the semi-automatic firearms, by means of which the problems with the existing configurations may be overcome and many advantages may be additionally provided, said novel system eliminating the need to replace the pistons in order to use cartridges of different weights and enabling the kickback force to affect the user to a lesser extent.

Another object of the invention is to reduce the kickback force during the use of the cartridges of high weight, thereby preventing damage to the mechanisms of the rifle.

Another object of the invention is to reduce by a preferred ratio the kickback force during the use of the cartridges of high weight, thereby providing the user with the ability of a comfortable shot. The invention thus aims to eliminate the problem of kickback emerging during the use.

Another object of the invention is to set forth a barrel system that will be able to generate a force to enable the operation of the system while using the lightweight cartridges. In this way, the invention aims to enable the use by way of adjusting the pressure values without having to replace the pistons when using both the lightweight cartridges and the heavier cartridges.

Another object of the invention is to eliminate the need to replace the pistons according to the weight of the cartridge, thereby overcoming the possible problems resulting from the replacement of the pistons. The invention thus aims to develop an operating system whereby the required pressure force may be adjusted.

In order to achieve the objects of the invention, a novel operating system has been developed for the semi-automatic firearms, whereby the kickback force is reduced and the need is eliminated to replace the pistons according to the weight of the cartridges.

REFERENCE NUMBERS

Figure 1:
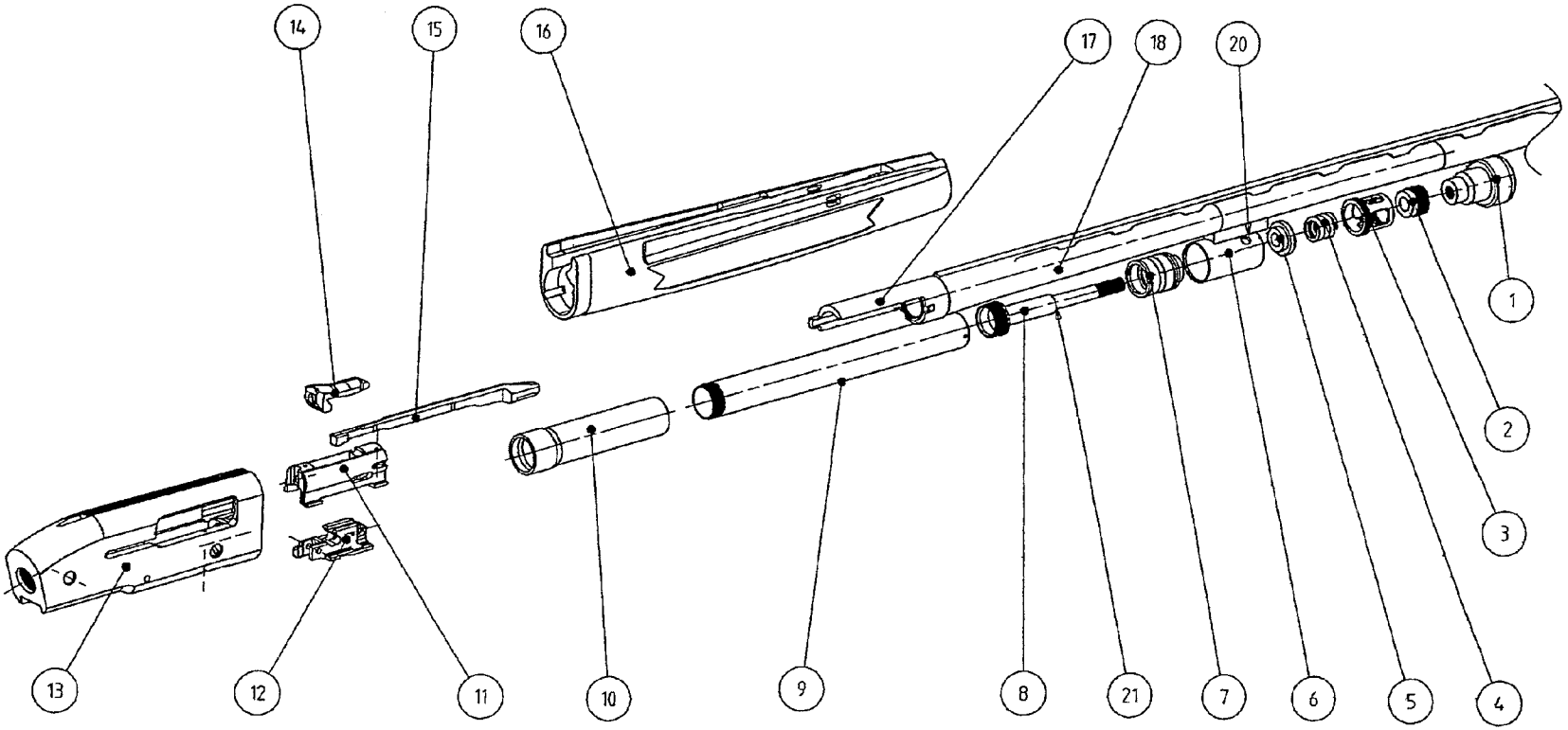
FIG. 1: A representative perspective drawing of the invention in disassembled state.
Figure 2:
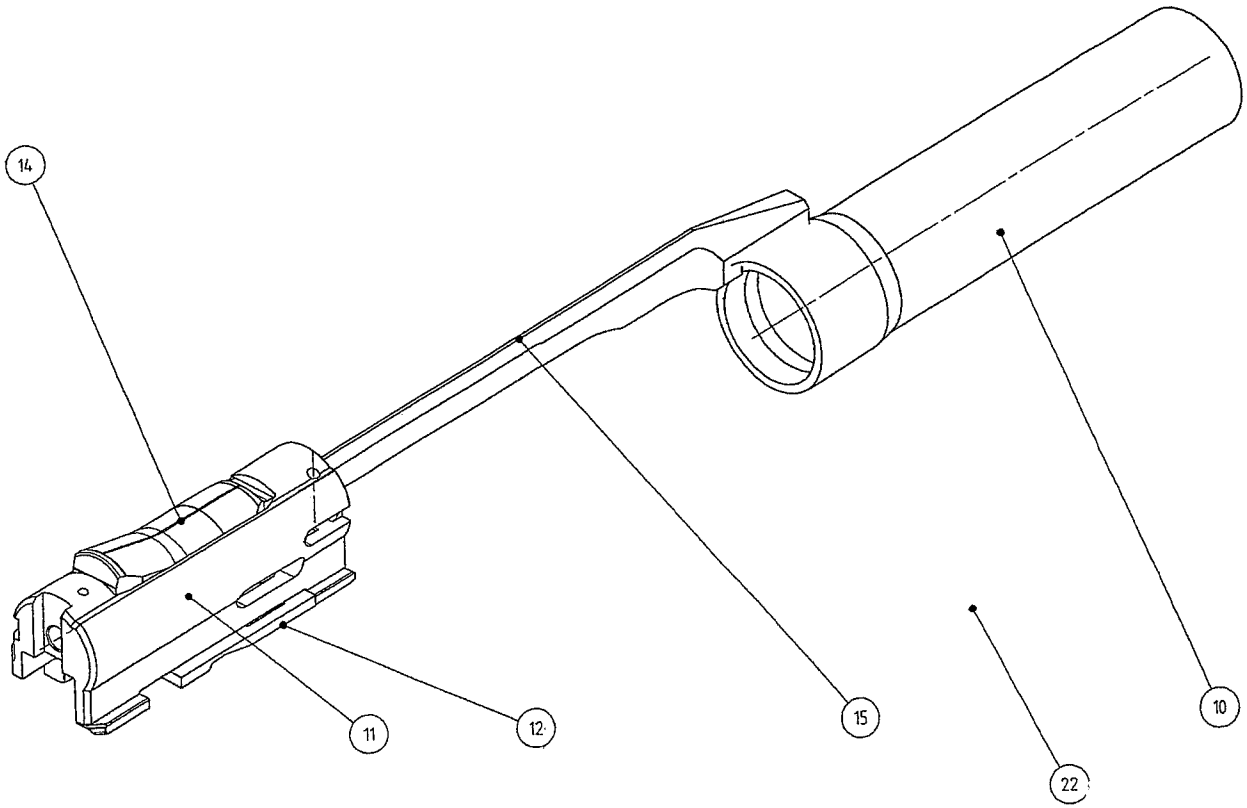
FIG. 2: A representative perspective drawing of the mechanism embodiment of the invention.
Figure 3:
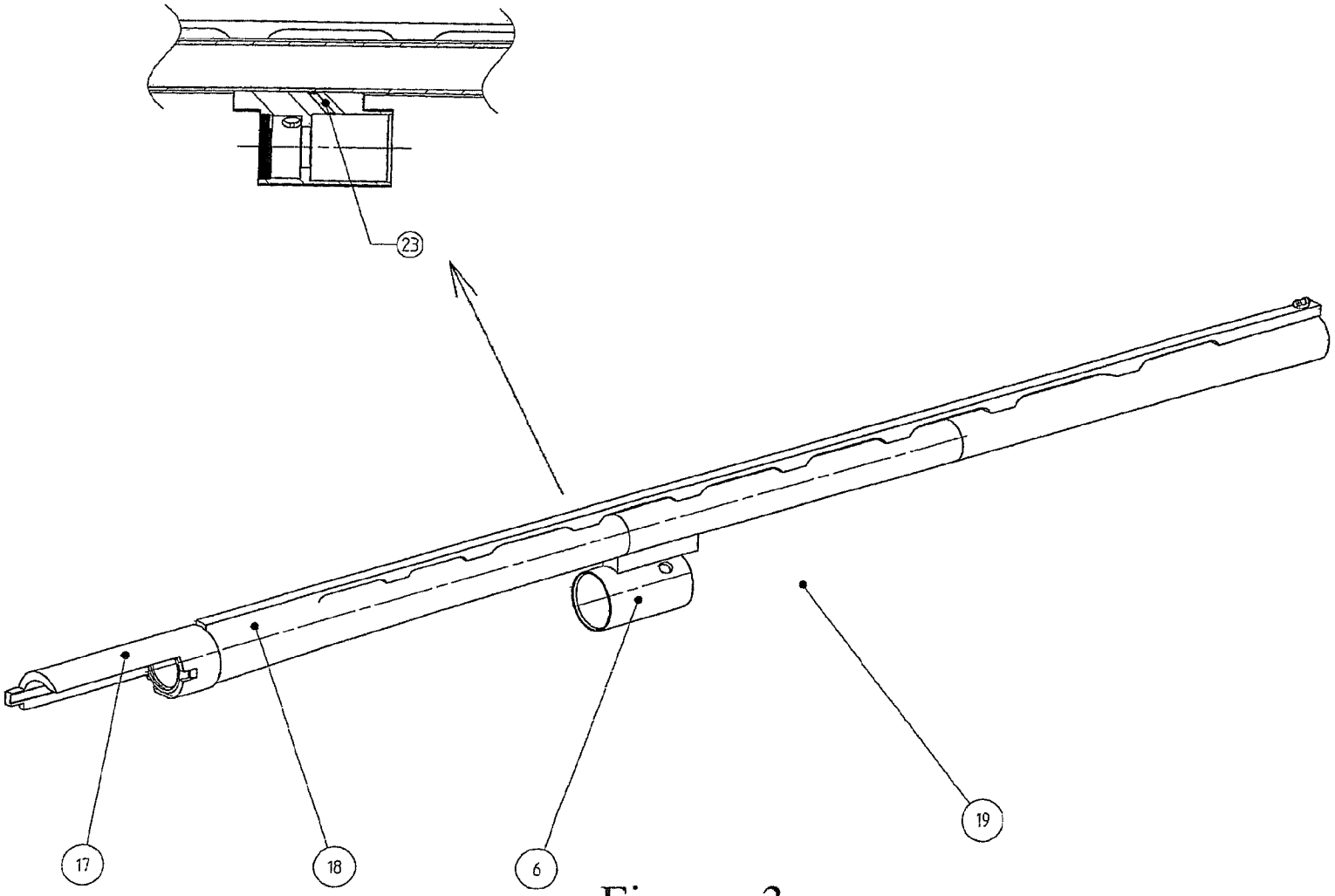
FIG. 3: A representative drawing of the barrel structure and the bracket gas hole of the invention.
Figure 4:
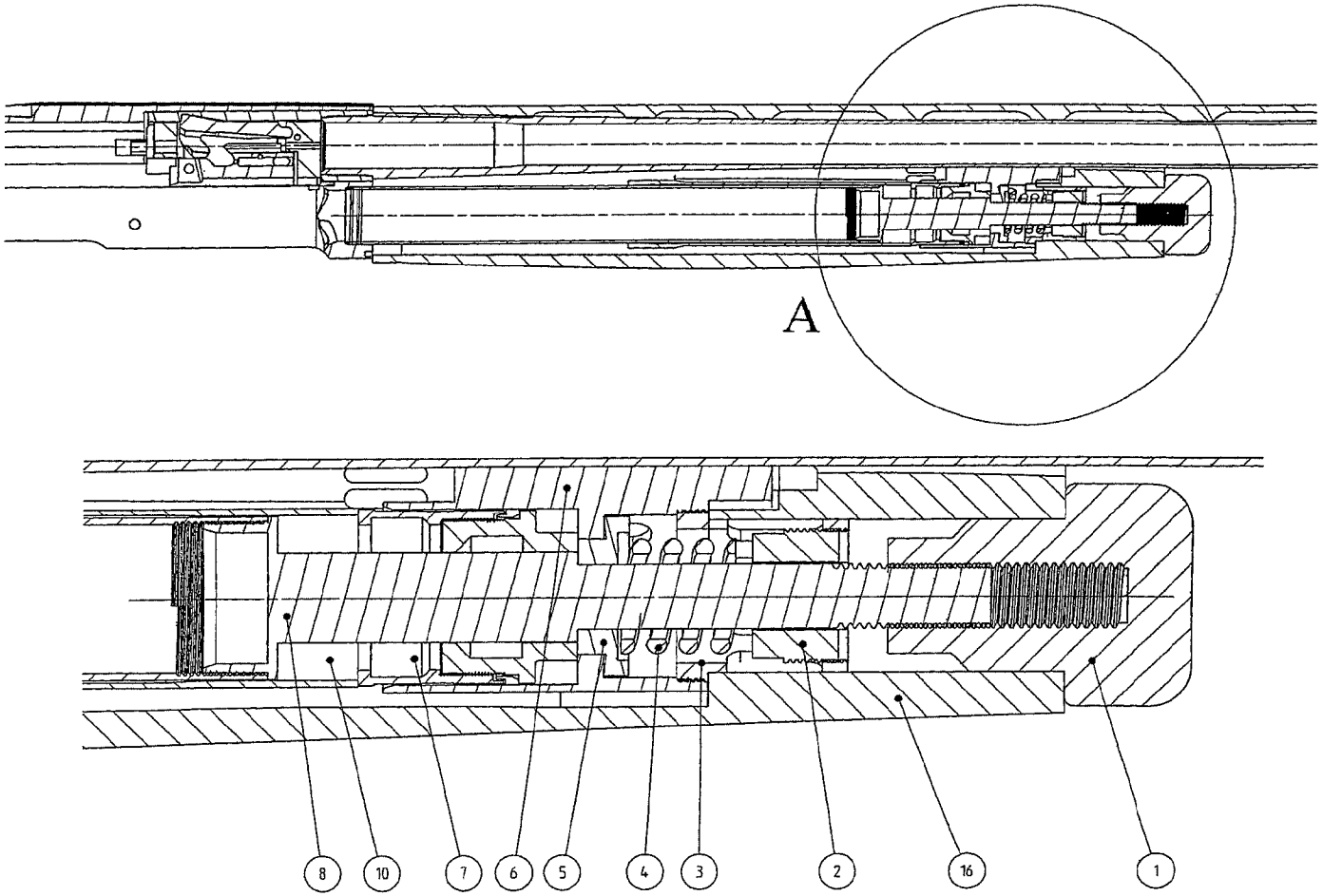
FIG. 4: A representative sectional drawing of the invention according to Detail-A.

| | |
|---|---|
| 1 | Hand stock nut |
| 2 | Valve adjustment nut |
| 3 | Valve body |
| 4 | Valve spring |
| 5 | Valve piston |
| 6 | Bracket |
| 7 | Piston |
| 8 | Magazine tube plug |
| 9 | Magazine tube |
| 10 | Gas tube |
| 11 | Mechanism |
| 12 | Lock bolt |
| 13 | Body |
| 14 | Lock |
| 15 | Bolt arm |
| 16 | Hand stock |
| 17 | Barrel cap |
| 18 | Barrel |
| 19 | Barrel structure |
| 20 | Barrel bracket gas discharge hole |
| 21 | Valve piston positioning surface |
| 22 | Mechanism embodiment |
| 23 | Bracket gas hole |

DETAILED DESCRIPTION OF THE INVENTION

Owing to the operating system for the semi-automatic firearms according to the invention, the need is eliminated to replace the pistons (7) for the cartridges with different weights and the kickback force is reduced.

As will be seen in the figures, there are present the hand stock nut (1), the valve adjustment nut (2) enabling the adjustment according to the weight of the cartridge, valve body (3), valve spring (4), valve piston (5), the piston (7) mounted through the bracket (6), the magazine tube plug (8), the magazine tube (9) and the gas tube (10). There are also present the mechanism (11) associated with the gas tube (10), the lock bolt (12) associated with the mechanism (11), the body (13), the lock (14) and the hand stock (16). There are also present the barrel cap (17) associated with the hand stock (16), and the barrel (18), and the excess gas is discharged through the barrel bracket gas discharge holes (20) on the bracket (6) positioned in the lower part of the barrel (18).

As a result of the firing of the cartridge, the barrel structure (19) moves backwards by the force formed at the instant of explosion. During this movement, the valve piston (5) positioned on the valve piston positioning surface (21) in the magazine plug (8) advances by the desired extent, depending on the pressure generated by the cartridge being used at the instant of explosion. Said advance in the valve piston (5) enables a portion of the gas to be discharged via the gas discharge holes (20) on the barrel bracket (6).

When the advancing gas reaches the piston (7) positioned at the opposite side of the barrel bracket (6), the piston (7) begins to move and operates the mechanism embodiment (22). If the pressure of the incoming gas is high, the valve piston (5) is automatically adjusted to discharge the excess gas via the barrel bracket gas discharge holes (20).

In order for the valve piston (5) to be able to automatically function, it should be secured at the optimum level by means of the valve adjustment nut (2). The valve piston (5) also allows manual adjustment in order to adjust the kickback force. The kickback force may be adjusted thanks to the valve piston (5), valve spring (4), valve body (3) and valve adjustment nut (2). The gas recoil reaches up to the valve piston (5), but it is not able to arrive at the valve spring (4), valve body (3) and valve adjustment nut (2). In this way, the possible failures during the operation of the firearm have been avoided.

Different forms of valve piston (5), valve spring (4), valve body (3) and valve adjustment nut (2) may be used. The barrel bracket gas discharge holes (20) with different shapes may be formed at different positions on the bracket (6). In cases where the gas pressure is excessive, the discharge is performed via the gas holes (20) on the bracket (6) upon the operation of the firearm system. When the valve piston (5) advances, the gas discharge holes (20) on the bracket (6) are opened to enable discharge.

The gas emitted following the explosion passes through the bracket gas holes (23) to move the piston (7), meanwhile the gas reaching the valve piston (5) is discharged through the barrel bracket gas discharge holes (20) according to the amount associated with the adjustment of the valve piston (5) before reaching the valve adjustment nut (2), valve body (3) and valve spring (4), thereby adjusting the kickback force via the piston (7).

The invention claimed is:

1. A semi-automatic firearm comprising a hand stock nut (1), a bracket (6), a piston (7), a magazine tube plug (8), a magazine tube (9), a gas tube (10), a mechanism (11), a lock bolt (12), a body (13), a lock (14), a bolt arm (15), a hand stock (16), a barrel cap (17), a barrel (18), wherein the barrel (18) and the bracket (6) are in fluid communication by a bracket gas hole (23), which feeds into the bracket (6) behind a valve piston (5), wherein the hand stock nut (1) is adjustably coupled to the magazine tube plug (8) such that the hand stock nut (1) can be used to adjust the kickback force and the force by which the piston (7) operates the mechanism (11) according to the weight of the cartridge, and discharge holes (20) through which gas passing from the barrel (18) through the bracket gas hole (23) is discharged from the bracket (8) once the valve piston (5) positioned on a valve piston positioning surface (21) of the magazine plug (8) moves forward within said bracket (6) under the force formed when a cartridge in the barrel structure (19) is fired, wherein the discharge holes (20) are sealed to the bracket gas hole (23) when the valve piston (5) is in a resting position, wherein the discharge holes (20) are positioned on the bracket (6) within which the piston (7) and the valve piston (5) are located.

2. The semi-automatic firearm system according to claim 1, further comprising a valve adjustment nut (2), a valve body (3), and a valve spring (4) associated with the valve piston (5) positioned between said hand stock nut (1) and the piston (7), wherein the valve spring (4) biases the valve piston (5) backward.

3. The semi-automatic firearm system according to claim 2, wherein gas emitted when a cartridge in the barrel (8) is fired passes through the bracket gas holes (23) to move the piston (7), and at the same time, the gas reaching the valve piston (5) is discharged through the discharge holes (20) according to the amount associated with the adjustment of the valve piston (5) before reaching the valve adjustment nut (2), valve body (3) and valve spring (4), thereby adjusting the kickback force via the valve adjustment nut (2).

4. The semi-automatic firearm system according to claim 1, wherein the discharge holes (20) are positioned in a dispersed manner at different points on the bracket (6) connected with the barrel (18), said barrel bracket gas discharge holes opening to discharge the discharge holes (20) in order to enable the discharge of cartridge firing gas at different recoil forces.

5. The semi-automatic firearm system according to claim 2, wherein the valve adjustment nut (2) enables the recoil and operating pressures to be adjusted according to different cartridge weights.

6. The semi-automatic firearm system according to claim 2, wherein the valve adjustment nut (2) adjusts the valve piston (5) via the valve body (3) and the valve spring (4) to adjust an amount of excess gas to be discharged from the discharge holes (20) and the magazine tube plug (8) comprises the valve piston positioning surface (21) where the valve piston (5) is positioned.

7. The semi-automatic firearm system according to claim 1, wherein as a result of firing a cartridge in the barrel (18), while the barrel structure (19) moves backwards by the force formed at the instant of explosion, the valve piston (5) positioned on the valve piston positioning surface (21) in the magazine plug (8) moves forward depending on the pressure generated by the cartridge being fired, by means of this advance of the valve piston (5), the gas discharge holes (20) on the barrel bracket (6) are opened and a portion of the gas is discharged produced by the cartridge.

8. A semi-automatic firearm comprising:

a hand stock nut (1), a valve piston (5), a bracket (6), a piston (7), a magazine tube plug (8), a magazine tube (9), a gas tube (10), a mechanism (11), a barrel (18), wherein the barrel (18) and the bracket (6) are in fluid communication by a bracket gas hole (23), which feeds into the bracket (6) behind the valve piston (5), wherein the hand stock nut (1) is rotatably coupled to the magazine tube plug (8) such that the hand stock nut (1) can be used to adjust the kickback force and the force by which the piston (7) operates the mechanism (11) according to the weight of the cartridge, and discharge holes (20) through which gas passing from the barrel (18) through the bracket gas hole (23) is discharged from the bracket (8) once the valve piston (5) positioned on a valve piston positioning surface (21) of the magazine plug (8) moves forward within said bracket (6) when a cartridge in the barrel structure (19) is fired, wherein the discharge holes (20) are sealed to the bracket gas hole (23) when the valve piston (5) is in a resting position, wherein the discharge holes (20) are positioned on the bracket (6) within which the piston (7) and the valve piston (5) are located.

* * * * *